US009914313B2

(12) United States Patent
Aoki et al.

(10) Patent No.: US 9,914,313 B2
(45) Date of Patent: Mar. 13, 2018

(54) PRINTING APPARATUS

(71) Applicant: SEIKO EPSON CORPORATION, Tokyo (JP)

(72) Inventors: Hiroki Aoki, Matsumoto (JP); Yoshitsugu Tokai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/277,427

(22) Filed: Sep. 27, 2016

(65) Prior Publication Data

US 2017/0087899 A1 Mar. 30, 2017

(30) Foreign Application Priority Data

Sep. 30, 2015 (JP) ..... 2015-194704

(51) Int. Cl.
*B41J 13/03* (2006.01)

(52) U.S. Cl.
CPC ..... *B41J 13/03* (2013.01)

(58) Field of Classification Search
CPC ..... B41J 13/03; B41J 13/025
See application file for complete search history.

(56) References Cited

U.S. PATENT DOCUMENTS

2016/0272452 A1 9/2016 Tokai et al.

FOREIGN PATENT DOCUMENTS

| | | | |
|---|---|---|---|
| JP | 05-065418 B | | 1/1991 |
| JP | 2004-026380 A | | 1/2004 |
| JP | 2007-030997 A | | 2/2007 |
| JP | 2007030997 A | * | 2/2007 |
| JP | 2007-168961 A | | 7/2007 |

* cited by examiner

*Primary Examiner* — Julian Huffman
*Assistant Examiner* — Michael Konczal
(74) *Attorney, Agent, or Firm* — Workman Nydegger

(57) ABSTRACT

A printing apparatus includes a printing portion for printing on a medium, a driving roller for transporting the medium, a first and a second driven roller which are respectively supported with a gap in one roller shaft in a shaft line direction of the roller shaft and rotate around the roller shaft while pressing the transported medium on the driving roller, and a shaft support member that has a shaft support portion which supports the roller shaft between the first driven roller and the second driven roller. The first and the second driven roller have a through hole into which the roller shaft is inserted and an inner diameter in a roller center portion is smaller than an inner diameter of a roller end portion in the shaft line direction. The roller shaft is supported so as to be swingable with the shaft support portion as a support point.

5 Claims, 12 Drawing Sheets

PRINTING APPARATUS

BACKGROUND

1. Technical Field

The present invention relates to a printing apparatus which transports a medium that is a printing target.

2. Related Art

A printer which is an example of a printing apparatus has a driving roller which transports a medium to a printing portion, and a plurality of driven rollers which are supported to be rotated respectively to one end side and another end side of one roller shaft and transport the transported medium with interposed between the driving roller and the driven roller by being rotated while pressing the medium on the driving roller.

In such a printer, it is possible to hold a revolving shaft of the driving roller and a revolving shaft of the driven roller in parallel by setting a form of a hole which is provided in the driven roller, in which the roller shaft is insertable, as a taper form in which the inner diameter is small in a center portion with respect to a shaft direction and becomes larger accompanying movement to both ends (for example, JP-A-2007-168961).

However, in a printer in the related art, in a case where a plurality of driven rollers are rotatably supported by one roller shaft, there are cases in which, for example, at both end portions in a width direction which intersects with a transport direction of a medium, out of the plurality of driven rollers, a driven roller between which and a driving roller the medium is interposed and a driven roller between which and a driving roller the medium is not interposed are mixed.

In such a case, since it is possible to hold the revolving shaft of the driven roller and the revolving shaft of the driving roller in parallel by the driven roller on which a hole is set in a taper form, pressing force that is applied to the medium of the driven roller which interposes the medium is able to be a larger pressing force than pressing force that is applied to the medium of the driven roller when all of a plurality of driven rollers interpose the medium. As a result, in a case where the plurality of driven rollers are attached to one roller shaft, there is a problem in that load which presses on the medium is not uniform and roller transfer scratches and nip marks are generated on the medium.

Note that, such a problem is not limited to a printer, and is generally common in a printing apparatus which interposes the medium and transports the medium to the printing portion.

SUMMARY

An advantage of some aspects of the invention is to provide a printing apparatus that is able to transport a medium at a uniform pressing force using a plurality of driven rollers that are rotatably supported in one roller shaft.

Hereinafter, means of the invention and operation effects thereof will be described.

There is provided a printing apparatus including a printing portion which performs printing on a medium, a driving roller which transports the medium to the printing portion, a first driven roller and a second driven roller which are respectively supported with a gap in one roller shaft in a shaft line direction of the roller shaft and rotate around the roller shaft while pressing the transported medium on the driving roller, and a shaft support member that has a shaft support portion which supports the roller shaft between the first driven roller and the second driven roller, in which the first driven roller and the second driven roller have a through hole into which the roller shaft is inserted and in which an inner diameter in a roller center portion is smaller than an inner diameter of a roller end portion in a shaft line direction of a roller shaft, and in the shaft support member, the roller shaft is supported so as to be swingable with the shaft support portion as a support point.

According to this configuration, for example, in one roller shaft, in a case where only the first driven roller presses the medium, pressing force of the first driven roller on the medium is suppressed to pressing force at which both the first driven roller and the second driven roller press the medium due to swinging by the roller shaft. As a result, it is possible to transport the medium at a uniform pressing force using the first driven roller and the second driven roller.

In the printing apparatus, it is preferable that the shaft support portion of the shaft support member is a bearing surface which is able to contact a side surface of the roller shaft and has a gap with the side surface of the roller shaft.

According to this configuration, one roller shaft is swingable with the bearing surface as a support point by a gap with the bearing surface, and in a case where the one roller shaft does not swing, the side surface is stably supported by the shaft support member by contacting (being in line contact or surface contact) the bearing surface.

In the printing apparatus, it is preferable that in at least one of the first driven roller and the second driven roller, the roller center portion in the through hole is a cylindrical surface which is able to contact the side surface of the roller shaft and has a gap with the side surface of the roller shaft.

According to this configuration, the first driven roller and the second driven roller are swingable with the cylindrical surface as a support point by a gap between the side surface of the roller shaft and the cylindrical surface, and in a case where the driven rollers do not swing, the cylindrical surface is stably supported by the roller shaft by contacting (being in line contact or surface contact) the side surface of the roller shaft.

In the printing apparatus, it is preferable that in one roller shaft, a shaft part which is supported by the shaft support portion of the shaft support member is thicker than a shaft part which rotatably supports the first driven roller and the second driven roller.

According to this configuration, in a case where bending force is applied to a support point of swinging, in a thick roller shaft at the support point of swinging, change of shape due to bending force is suppressed by reaction force of the pressing force that is caused when the first driven roller and the second driven roller press the medium with respect to one roller shaft.

In the printing apparatus, it is preferable to include a guide groove that movably guides at least one shaft end portion out of both shaft end portions of the one roller shaft along a pressing direction in which the first driven roller and the second driven roller press the medium on the driving roller.

According to this configuration, since one roller shaft is caused to swing along the pressing direction in which the first driven roller and the second driven roller press the medium on the driving roller, it is possible to appropriately suppress pressing force at which the first driven roller and the second driven roller press the medium due to swinging of the roller shaft.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of a printing apparatus will be described below with reference to the drawings. For example, the printing apparatus is a large format printer which performs printing (recording) on a long medium.

Figure 1:
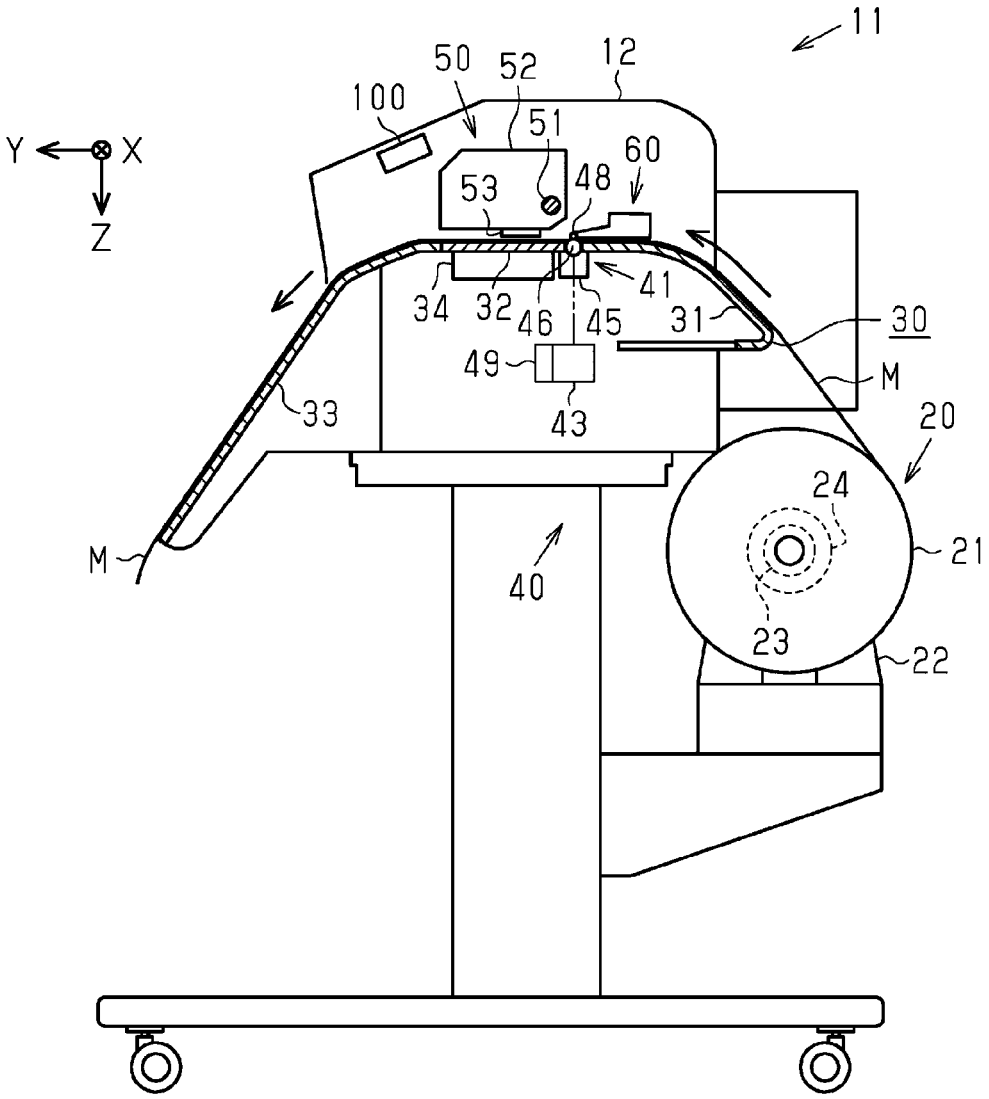
FIG. 1 is a configuration diagram schematically illustrating a configuration of an embodiment of a printing apparatus.

As shown in FIG. 1, a printing apparatus 11 is provided with a chassis portion 12, a medium support portion 30 which supports a medium M, a transport device 40 which transports the medium M in a direction indicated by an arrow in FIG. 1, and a printing portion 50 which performs printing on the medium M within the chassis portion 12.

Hereinafter in the description, one direction along a width direction (direction which is orthogonal to a paper surface in FIG. 1) which is orthogonal to a longitudinal direction of the medium M is set as a scanning direction X and a direction in which the medium M is transported at a position at which the printing portion 50 performs printing is set as a transport direction Y. In the embodiment, the scanning direction X and the transport direction Y are directions which intersect with (preferably orthogonal to) each other, and both are a direction which intersects with (preferably orthogonal to) a direction of gravity Z.

The medium support portion 30 is provided with a first medium support portion 31, a second medium support portion 32, and a third medium support portion 33 which form a transport path of the medium M, and a suction mechanism 34 which is disposed below the second medium support portion 32 in the direction of gravity Z. The first medium support portion 31 has an inclined surface which is inclined such that a downstream side is higher than an upstream side in the transport direction Y. The second medium support portion 32 is provided at a position which faces the printing portion 50 and supports the medium M on which printing is performed. The third medium support portion 33 has an inclined surface which is inclined such that a downstream side is lower than an upstream side in the transport direction Y, and the medium M is guided on which printing is performed by the printing portion 50.

The printing portion 50 is provided with a guide shaft 51 which extends in the scanning direction X, a carriage 52 which is supported on a guide shaft 51, and a liquid discharge portion 53 that discharges ink, which is an example of a liquid, on the medium M. The carriage 52 is reciprocally moved along a scanning direction X along the guide shaft 51 due to driving of a carriage motor which is not illustrated. The liquid discharge portion 53 is supported on the carriage 52 so as to face the medium M that is supported on the second medium support portion 32. Then, the printing portion 50 performs a printing operation which forms a character or an image on the medium M by discharging ink from the liquid discharge portion 53 when the printing portion 50 moves along the scanning direction X of the carriage 52.

The second medium support portion 32 has a plurality of suction holes which are not illustrated on a support surface that supports the medium M, and lifting up of the medium M from the support surface is suppressed by suctioning the medium M through the suction hole due to driving of the suction mechanism 34. In addition, contact with the liquid discharge portion 53 is suppressed by lifting up of the printed medium M by driving the suction mechanism 34 also during transport of the medium M.

The transport device 40 is provided with a transport roller pair 41 which is provided between the first medium support portion 31 and the second medium support portion 32 in the transport direction Y, a transport motor 43, and a control portion 100 which performs control of configuration elements of the transport device 40. In the embodiment, the control portion 100 is configured as a control portion which performs control of the configuration elements of the printing apparatus 11. In addition, in the embodiment, a revolving shaft direction of the transport roller pair 41 is a direction along the scanning direction X.

The transport roller pair 41 is configured as a pair of a driving roller 46 which is supported on a support base 45 and a driven roller 48 on which a roller shaft 80 (refer to FIG. 9) is supported on the shaft support member 60. The driving roller 46 rotates in a first rotation direction (counterclockwise direction in FIG. 1) in which the medium M is transported in the transport direction Y and a second rotation direction (clockwise direction in FIG. 1) in which the medium M is returned in a reverse direction to the transport direction Y due to driving of the transport motor 43. Note that, the transport device 40 is provided with a rotary encoder 49 for detecting an amount of rotation of the driving roller 46 in the first rotation direction and the second rotation direction.

The shaft support member 60 which supports the roller shaft 80 of the driven roller 48 which configures the transport roller pairs 41 is biased by a spring 73 (refer to FIG. 3) that is an example of a biasing member. Due to biasing, in a state of interposing the medium M between the driven roller 48 and the driving roller 46, the driving roller 46 and the driven roller 48 interpose the medium M by the driven roller 48 pressing the medium M on the driving roller 46. Then, the driving roller 46 transports the medium M in the transport direction Y by rotating in the first rotation direction in a state in which the medium M is interposed by the driving roller 46 and the driven roller 48, that is, the transport roller pair 41 interpose the medium M.

The transport device 40 is provided with a feeding portion 20 which feeds the medium M toward the driving roller 46 when the transport roller pair 41 transports the medium M in the transport direction Y. The feeding portion 20 has a holding portion 22 which rotatably holds a roll body 21 in which the medium M is wound superimposed in a roll shape, a feeding motor 23 for rotating the roll body 21 in both directions of a feeding direction (counterclockwise direction in FIG. 1) and a return direction (clockwise direction in FIG. 1), and a rotary encoder 24 for detecting the amount of rotation of the roll body 21.

The holding portion 22 is able to hold a plurality of types of roll bodies 21 which have different lengths or winding numbers in the scanning direction X. Then, the feeding portion 20 feeds the medium M toward the driving roller 46 by rotating the roll body 21 in the feeding direction and winding the medium M on the roll body 21 by returning in the opposite direction from the transport direction Y by rotating in the return direction.

Figure 2:
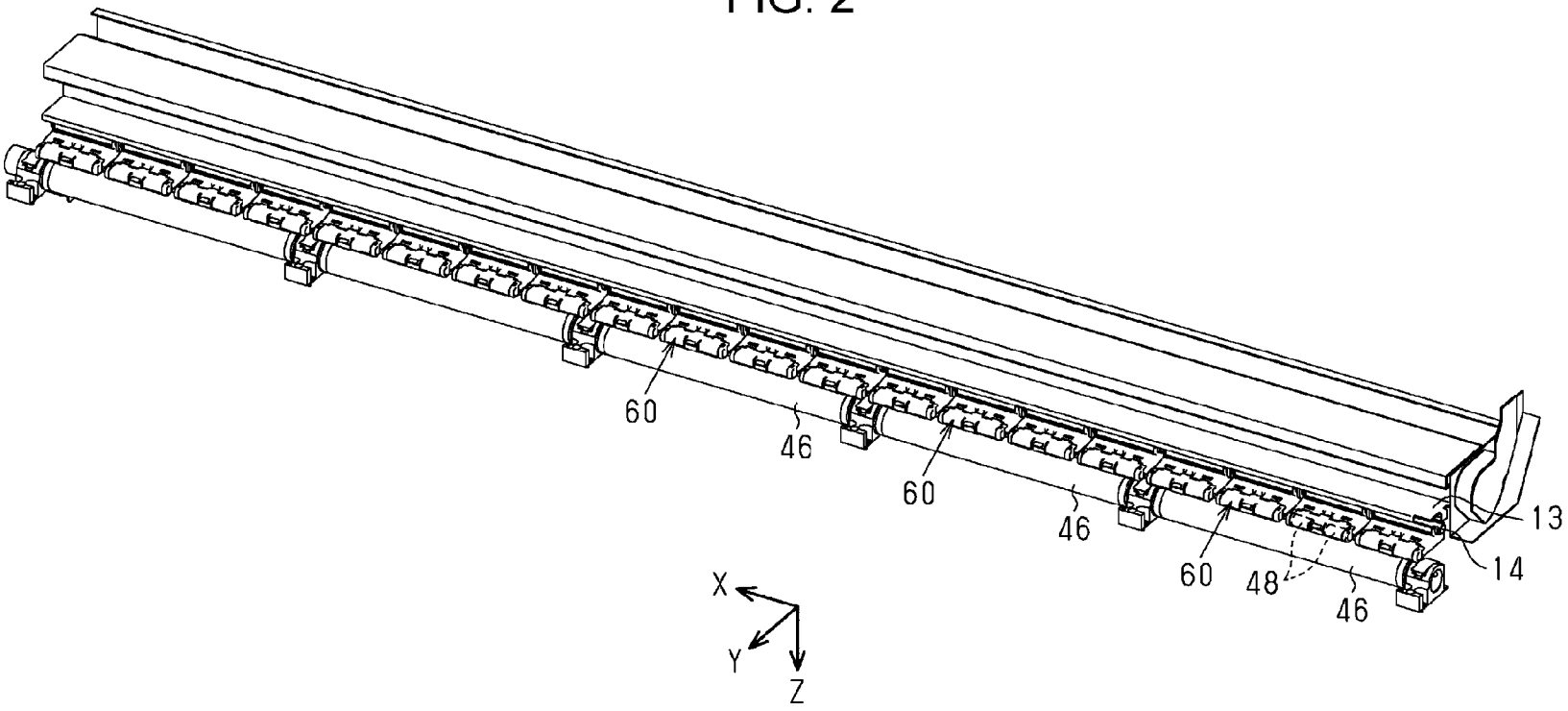
FIG. 2 is a perspective view illustrating a plurality of driven rollers which transport a medium to a printing portion.

As shown in FIG. 2, a plurality of shaft support bodies 60 (here, 20) are provided in the scanning direction X in a state of being supported on a rotary shaft 14 that is installed to freely rotate on a support frame 13 which is attached within the chassis portion 12. One roller shaft 80 (refer to FIG. 9) which supports a plurality of driven rollers 48 to freely rotate to be respectively supported on each shaft support member 60 that is supported on the rotary shaft 14.

In the embodiment, respective two driven rollers 48 are rotatably supported centered on the roller shaft 80 on each roller shaft 80. Note that, in a case where two driven rollers 48 are distinguished, one is referred to as a first driven roller 48 and the other is referred to as a second driven roller 48. Of course, in the embodiment, the number of shaft support bodies 60 and the number of driven rollers 48 which are supported by the roller shaft 80 is able to be arbitrarily modified.

A release shaft 15 (refer to FIG. 4) that rotates a release cam 65 is rotatably supported on the support frame 13 at a position on the upstream by the rotary shaft 14 in the transport direction Y. In addition, an adjustment shaft 16 (refer to FIG. 4) that rotates a cam member 66 is rotatably supported at a position on the upstream by the release shaft 15 in the transport direction Y.

Next, the configuration of the shaft support member 60 will be described.

Figure 3:
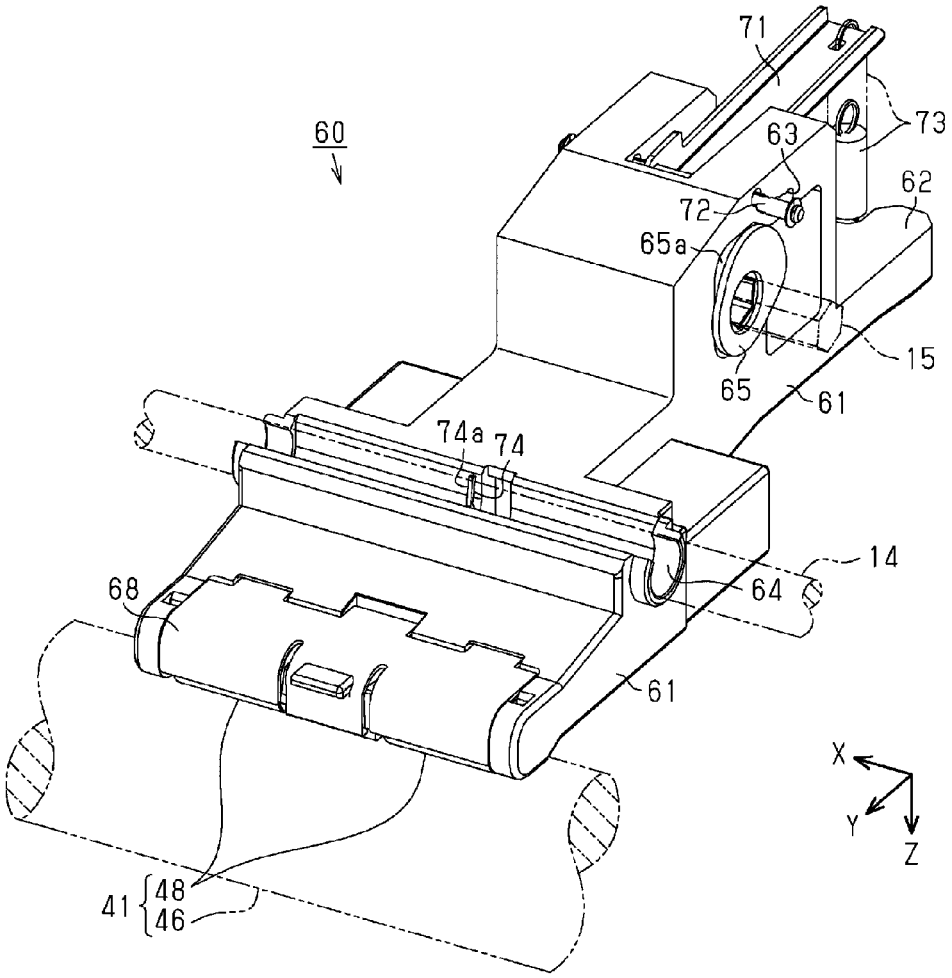
FIG. 3 is a perspective view illustrating a shaft support member which supports a roller shaft of a driven roller.
Figure 4:
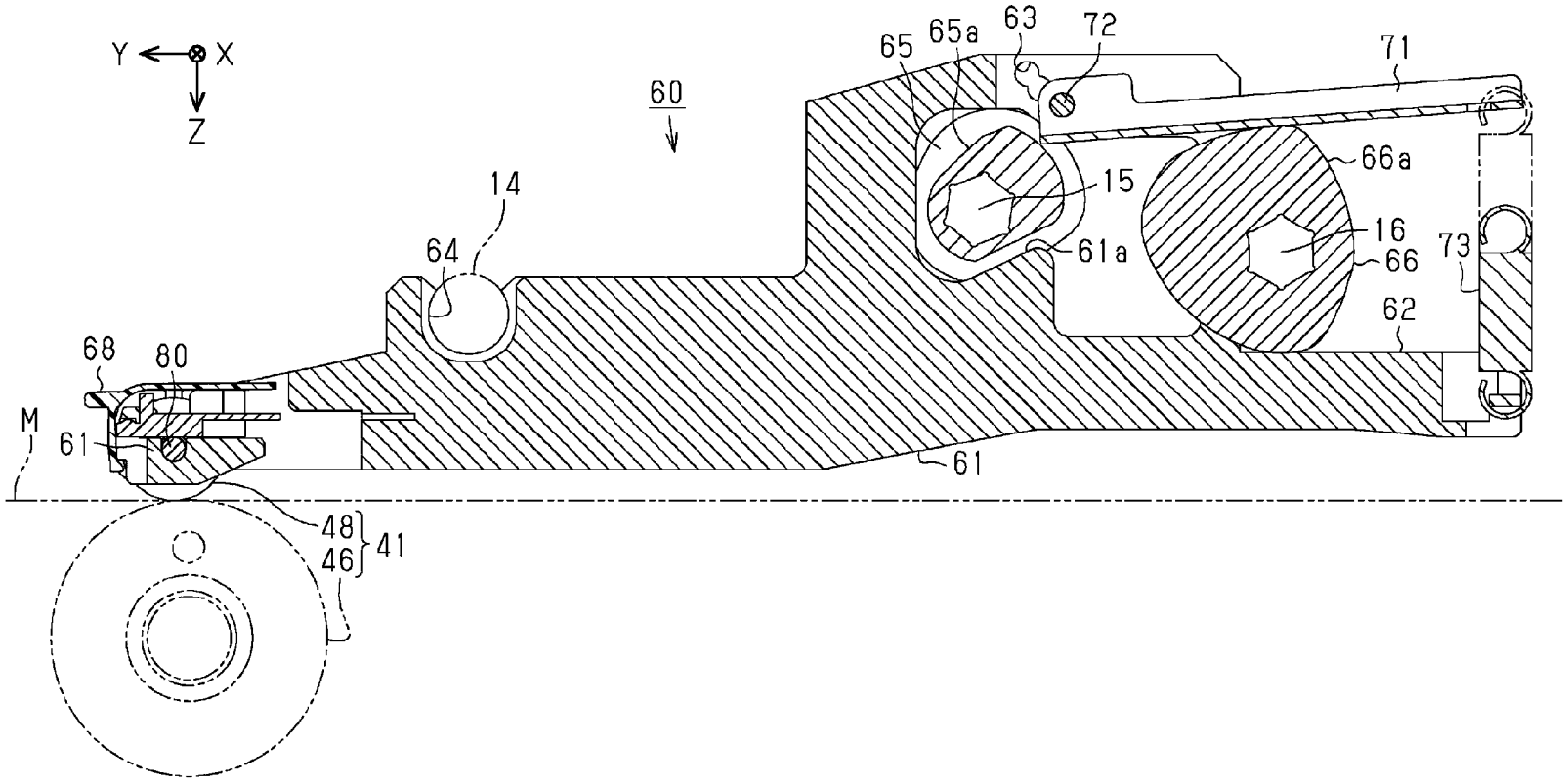
FIG. 4 is a side sectional view illustrating a state in which the shaft support member is cut on a surface which intersects with a shaft line direction of the roller shaft.

As shown in FIGS. 3 and 4, the shaft support member 60 has a rotating member 61 that is rotatably attached to the rotary shaft 14 via a shaft attachment portion 64, a locking member 71 that is rotatably supported on the rotating member 61, and a cover 68 which covers the driven roller 48. In addition, the release cam 65 and the cam member 66 are provided on the shaft support member 60, the release cam 65 which is rotated by the release shaft 15 abuts with the rotating member 61 and the cam member 66 which is rotated by the adjustment shaft 16 abuts with the locking member 71.

In addition, the spring 73 which generates force (contraction force) by extension and a torsion spring 74, which has conductivity, that is contacted by one end side 74*a* to the rotary shaft 14 when the rotating member 61 is attached to the rotary shaft 14, are combined in the rotating member 61.

The rotating member 61 is attached by the roller shaft 80 which supports the driven roller 48 to freely rotate in the downstream side end portion in the transport direction Y and is supported on the rotary shaft 14 in a state in which one end (lower end) of the spring 73 is locked by an extending portion 62 that is provided on an upstream side end portion in the transport direction Y. In addition, a long hole 63 in which a plurality of round holes are continuous are provided on the rotating member 61.

The locking member 71 is supported on the rotating member 61 in a state in which a base end portion (left end portion in FIG. 4) to freely rotate centered on a pin 72 that is inserted into one round hole of the long hole 63, and is in a state in which a tip end portion (right end portion in FIG. 4) locks a second end (upper end) of a spring 73. Note that, the locking member 71 is attached to a position that is above the extending portion 62 in the rotating member 61.

The cam member 66 has a cam surface 66*a* on which distance from the adjustment shaft 16 is continuously changed, the cam surface 66*a* is disposed so as to contact a position between the base end portion and the tip end portion of the locking member 71. In a case where the locking member 71 receives pressing force of the cam member 66 between the base end portion and the tip end portion in the transport direction Y, the tip end portion is rotated in a direction in which the spring 73 is expanded and contracted centered on the pin 72 that is inserted in the base end portion.

At this time, in the locking member 71, the base end portion operates as a support point, a part which receives pressing force from the cam member 66 operates as a pressure point, and the tip end portion operates as an action point (lever). Then, when the driven roller 48 is at an interposed position of the medium M, for example, contraction force is generated in the spring 73 according to a length of extension due to pressing force of the cam member 66 that is received by the locking member 71 and causing the spring 73 to extend.

In this manner, contraction force that is generated due to extension of the spring 73 is a biasing force that biases such that the rotating member 61 is rotated in a direction in which the medium M centered on the rotary shaft 14 is pressed on the driving roller 46 by the driven roller 48. As a result, with respect to the driven roller 48, the biasing force generates pressing force which presses the medium M on the driving roller 46 that is below the driven roller 48. In this point, the rotary shaft 14 functions as a revolving shaft that is a center of rotation when the shaft support member 60 is rotated in a direction in which the medium M is pressed on the driving roller 46 by the driven roller 48. In addition, the spring 73 functions as the biasing member which biases the driven roller 48.

The rotating member 61 has an abutting portion 61*a* that is able to abut with the cam surface 65*a* of the release cam 65 on the base end side further on the upstream side in the transport direction Y than the rotary shaft 14. Then, when the release cam 65 rotates in a clockwise direction in FIG. 4 centered on the rotary shaft 14 accompanying rotation of the release shaft 15, the release cam 65 extends the spring 73 and presses down the abutting portion 61*a*. Thereby, the rotating member 61 moves from the interposed position at which the medium M is interposed by the driven roller 48 between the driving roller 46 to the release position which is separated by the driven roller 48 from the driving roller 46 and at which interposing (nipping) of the medium M is released (refer to FIG. 6).

In this manner, for example, maintenance such as removal of the medium M is performed in a case where the medium M is clogged on the transport path due to the driven roller 48 being disposed at the release position. Furthermore, in the embodiment, for example, since the driven roller 48 is cleaned in a case where the driven roller 48 is soiled or the like and the driven roller 48 is replaced in a case where the driven roller 48 is worn out or the like, the driven roller 48 is configured to be able to be removed from the shaft support member 60.

Next, the structure in which the driven roller 48 is removed will be described with reference to FIGS. 5 to 10. Note that, when the driven roller 48 is removed, the driven roller 48 is positioned at the release position that is separated from the medium M due to pressing down of the abutting portion 61*a* of the release cam 65 and as indicated by the white arrow in FIG. 6, due to the rotating member 61 rotating centered on the rotary shaft 14.

Figure 5:
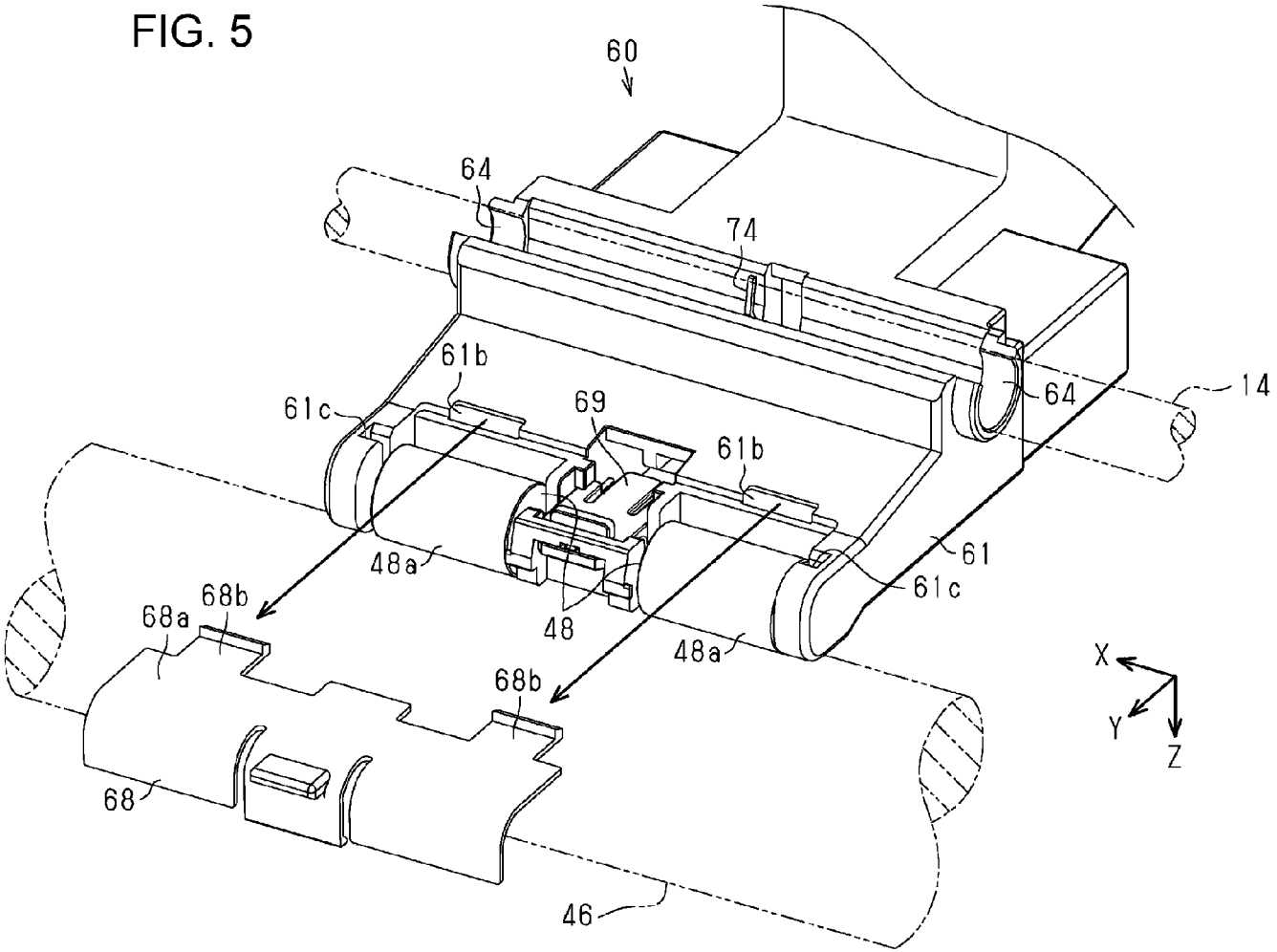
FIG. 5 is a perspective view illustrating a shaft support member that is in a state in which a cover is detached.
Figure 6:
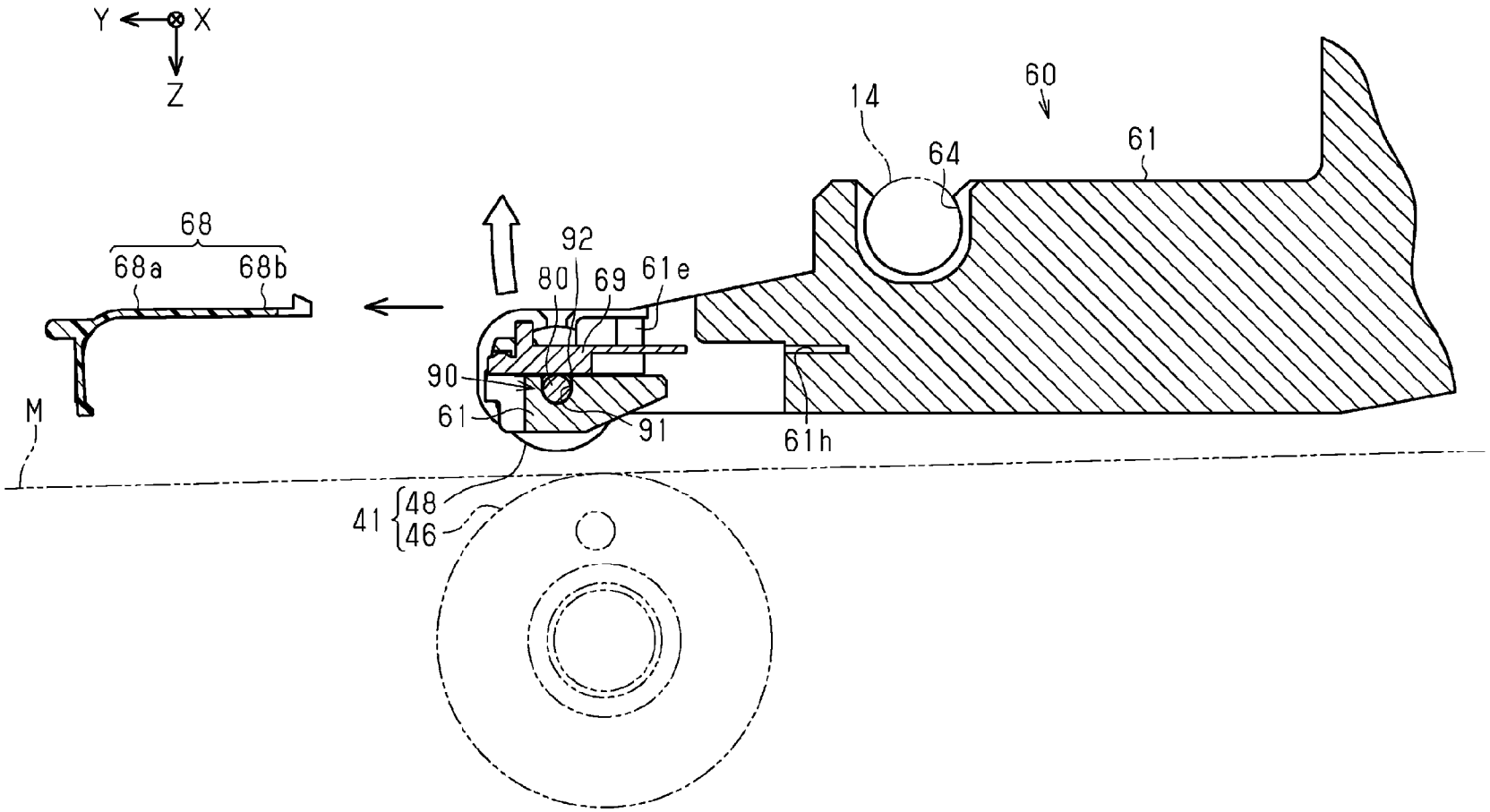
FIG. 6 is a side sectional view illustrating a state in which the shaft support member, which is in a state of the cover being detached, is cut on a surface which intersects with the shaft line direction of the roller shaft.

As shown in FIGS. 5 and 6, the cover 68 covers at least a part of a roller outer peripheral surface 48*a* of the driven roller 48 and is provided to be attachable and detachable with respect to the shaft support member 60. That is, the cover 68 has a covering portion 68*a* which covers the downstream side of the driven roller 48 in the transport direction Y and the upper side opposite from the medium M side, and two extending portions 68*b* that extend in a plate form on the upstream side in the transport direction Y from the covering portion 68*a*. The cover 68 is provided to be attachable and detachable with respect to the rotating member 61 (shaft support member 60) due to the extending portions 68*b* of the cover 68 being inserted from the downstream side in the transport direction Y with respect to an insertion portion 61*b* that is provided in the rotating member 61 of the shaft support member 60. Accordingly, for example, a user of the printing apparatus 11 removes the cover 68 from the rotating member 61 by pulling out the cover 68 in the state indicated in FIG. 3 to the downstream side of the transport direction Y as indicated by the arrow in FIG. 5 when replacing the driven roller 48.

In the state in which the cover 68 is removed, one roller shaft 80 which rotatably supports the driven roller 48 is inserted in a concave portion 91 (refer to FIG. 10) that is a bearing of the roller shaft 80 which is provided on the rotating member 61 between two driven rollers 48, and an opening 92 (refer to FIG. 10) which is provided on the upper side of the concave portion 91 is covered by a lid member 69.

That is, the shaft support member 60 is provided in the rotating member 61, and the concave portion 91 that has the opening 92 into which the roller shaft 80 is insertable from a direction (here upper direction) which intersects with a shaft line direction of the roller shaft 80 and the lid member 69 which covers the opening 92 are provided as the shaft support portion 90 which supports the roller shaft 80. Then, the shaft support portion 90 which is configured by the concave portion 91 and the lid member 69 supports the roller shaft 80 between the two driven rollers 48.

In the embodiment, the lid member 69 which configures the shaft support portion 90 is provided to be slidably movable from a closed position at which the opening 92 of the concave portion 91 is covered to an open position at which the opening 92 of the concave portion 91 is not covered. A sliding structure of the lid member 69 will be described with reference to the drawings.

Figure 7:
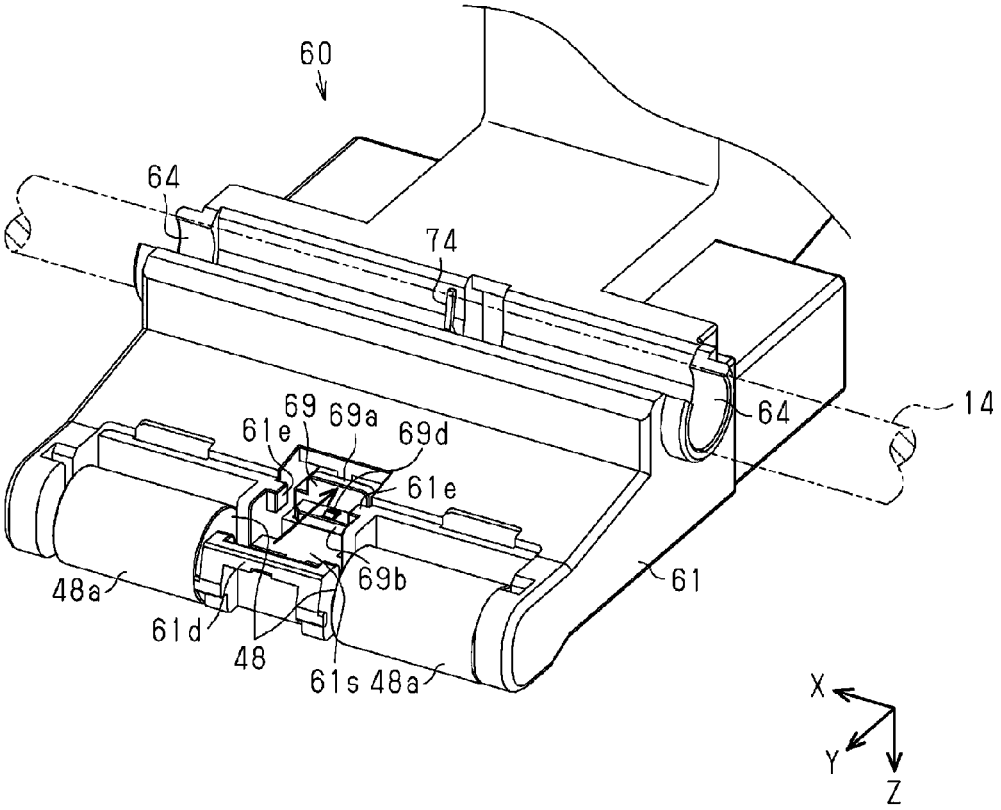
FIG. 7 is a perspective view illustrating the shaft support member that is in state in which a lid member is moved to an open position.
Figure 8:
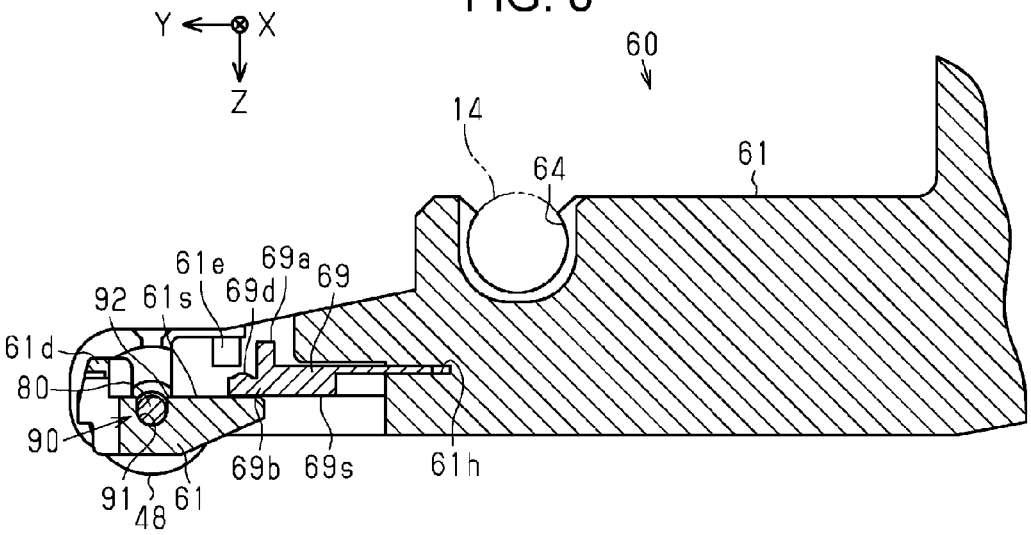
FIG. 8 is a side sectional view illustrating a state in which the shaft support member, which is in a state of the lid member being moved to the open position, is cut on a surface which intersects with the shaft line direction of the roller shaft.

As shown in FIGS. 7 and 8, the opening 92 on the upper side of the concave portion 91 which supports the roller shaft 80 is formed on a flat surface 61*s* that is provided on the end portion of the rotating member 61 on the downstream side in the transport direction Y. Then, the lid member 69 is provided to be slidably movable from a state indicated in FIG. 5 along the flat surface 61*s* of the rotating member 61 toward the upstream in the transport direction Y as indicated by the arrow in FIG. 7. That is, the lid member 69 slidably moves along the transport direction Y by sliding the flat surface 61*s* on which the opening 92 of the concave portion 91 is formed in the rotating member 61 by a convex portion 69*s* that protrudes to the lower side (refer to FIG. 12).

The lid member 69 is provided with a vertical wall portion 69*a* that extends upward on the downstream side of the transport direction Y and a flange portion 69*b* that extends from the vertical wall portion 69*a* toward the downstream side in the transport direction Y and on which a projection 69*d* is formed on an upper portion. Meanwhile, the vertical wall portion 69*a* of the lid member 69 contacts the downstream end in the transport direction Y and an engaging portion 61*d* in which the projection 69*d* is engaged in the up and down direction is provided in the rotating member 61 in a contact state.

The engaging portion 61*d* suppresses sliding movement along the transport direction Y of the lid member 69 and maintains the lid member 69 at the closed position by contacting the vertical wall portion 69*a* and engaging with the projection 69*d* in a state in which the lid member 69 is at the closed position (refer to FIG. 6). Meanwhile, engagement of the engaging portion 61*d* and the projection 69*d* is released by the vertical wall portion 69*a* pressing on the upstream side in the transport direction Y and the lid member 69 slidably moves from the closed position to the open position. Accordingly, the user of the printing apparatus 11 is opened on the upper side of the roller shaft 80 by pressing the lid member 69 to the upstream side in the transport direction Y.

Note that, during sliding movement of the lid member 69, lifting up of the lid member 69 is suppressed by a pair of protruding portions 61*e* which protrude in the scanning direction X provided on the rotating member 61 contacts (abuts with) the upper surface of the lid member 69 (refer to FIG. 6). In addition, the lid member 69 which is positioned at the closed position suppresses lifting up due to the pair of protruding portions 61*e* and the engaging portion 61*d*. Furthermore, the lid member 69 at the open position that is pressed on the upstream side in the transport direction Y suppresses movement in the up and down direction due to the upstream side end portion in the transport direction Y entering a groove portion 61*h* (refer to FIG. 6) which is provided on the rotating member 61.

Figure 9:
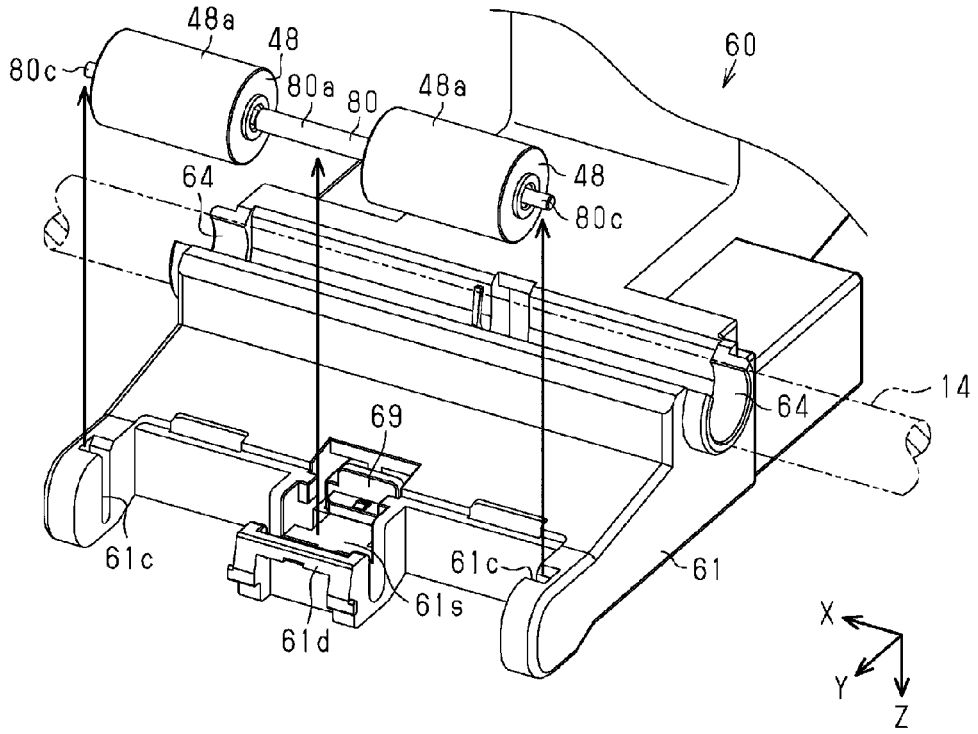
FIG. 9 is a perspective view illustrating the shaft support member in which the roller shaft of the driven roller is detached.
Figure 10:
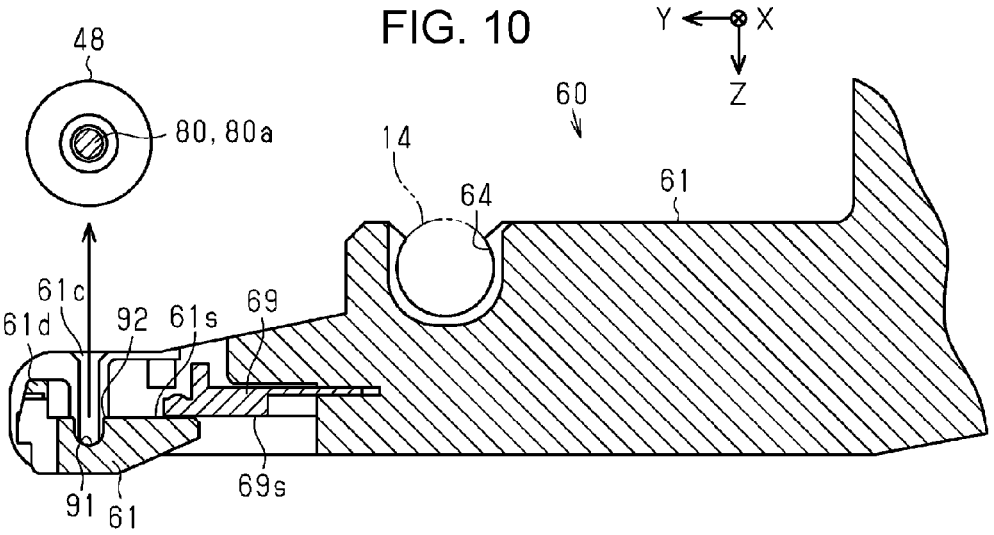
FIG. 10 is a side surface view illustrating a state in which the shaft support member, in which the roller shaft of the driven roller is detached, is cut on a surface which intersects with the shaft line direction of the roller shaft.

As shown in FIGS. 9 and 10, the roller shaft 80 in which the upper side is open is able to be extracted upward from the shaft support member 60. Then, the driven roller 48 which is rotatably supported in the roller shaft 80 is also taken out from the shaft support member 60 by extracting the roller shaft 80. That is, a shaft center part 80*a* of the roller shaft 80 which is positioned between the two driven rollers 48 is extracted upward from the concave portion 91 via the opening 92 of the concave portion 91 that is exposed due to sliding movement of the lid member 69 to the open position.

In the embodiment, in one roller shaft 80 which rotatably supports two driven rollers 48, the shaft center part 80*a* between the two driven rollers 48 is supported by the shaft support portion 90 of the shaft support member 60. In addition, in the one roller shaft 80, both shaft end portions 80*c* are formed so as to project to the outside further in the shaft direction than the respective two driven rollers 48 that are rotatably supported. Meanwhile, a pair of longitudinal grooves 61*c* which extend substantially in the up and down direction that is opened upward are formed in the rotating member 61 in the shaft support member 60. Each driven roller 48 moves in an up and down direction along a pressing direction in which the medium M is pressed on the driving roller 46 while suppressing movement in the transport direction Y by moving both shaft end portions 80*c* of one roller shaft 80 that is projected from each driven roller 48 along the respective longitudinal grooves 61*c*. Accordingly, the longitudinal grooves 61*c* function as guide grooves which movably guide both shaft end portions 80*c* of one roller shaft 80 along the pressing direction in which the medium M is pressed on the driving roller 46 respectively by the first and second driven rollers 48.

As shown in FIG. 9, each removed driven roller 48 along with the roller shaft 80 from the shaft support member 60 is extracted from the roller shaft 80 by being moved to the shaft end portion 80*c* side along the shaft line direction of the respective roller shafts 80. The extracted driven roller 48, for example, performs cleaning in a case where the roller outer peripheral surface 48*a* is soiled and is replaced by a new driven roller 48 in a case where the roller outer peripheral surface 48*a* is cleaned. Alternatively, the driven roller 48 is replaced with a driven roller 48 which is provided with the roller outer peripheral surface 48*a* that has a hardness or a friction coefficient that is appropriate for transport of the medium M.

The driven roller 48 that is cleaned or replaced is attached to the shaft support member 60 in reverse order from the removal procedure from the shaft support member 60 described above, that is, from the state indicated in FIG. 9 in order of the states respectively indicated in FIGS. 7, 5, and 3. Then, in each driven roller 48, the roller shaft 80 is supported on the shaft support portion 90 of the rotating member 61 in a state of being attached to the shaft support member 60. In other words, the shaft support member 60 supports the roller shaft 80 to be attachable and detachable with respect to the shaft support member 60 in the shaft support portion 90.

Note that, in the shaft support member 60, the rotating member 61 is formed in one member up to the concave portion 91 which configures the shaft support portion 90 of the rotary shaft 80 from the shaft attachment portion 64 that is attached to the rotary shaft 14, that is, in an aspect in which a plurality of members are not connected. That is, in the embodiment, the entirety of the rotating member 61 is formed in one member. Of course, other members may be incidentally provided in the rotating member 61 if up to the shaft support portion 90 (concave portion 91) of the roller shaft 80 from the shaft attachment portion 64 are connected in one member.

Next, with reference to FIGS. 11 and 12, the torsion spring 74 that is assembled in the shaft support member 60 and the driven roller 48 and the roller shaft 80 that are attached to the shaft support member 60 will be described. Note that, FIG. 11 is a diagram viewed from one side (right side in FIG. 5) in the scanning direction X of the shaft support member 60 indicated in FIG. 5, and FIG. 12 is a diagram viewed from the downstream side in the transport direction Y of the shaft support member 60 which includes a sectional view taken along line XII-XII in FIG. 11.

Figure 11:
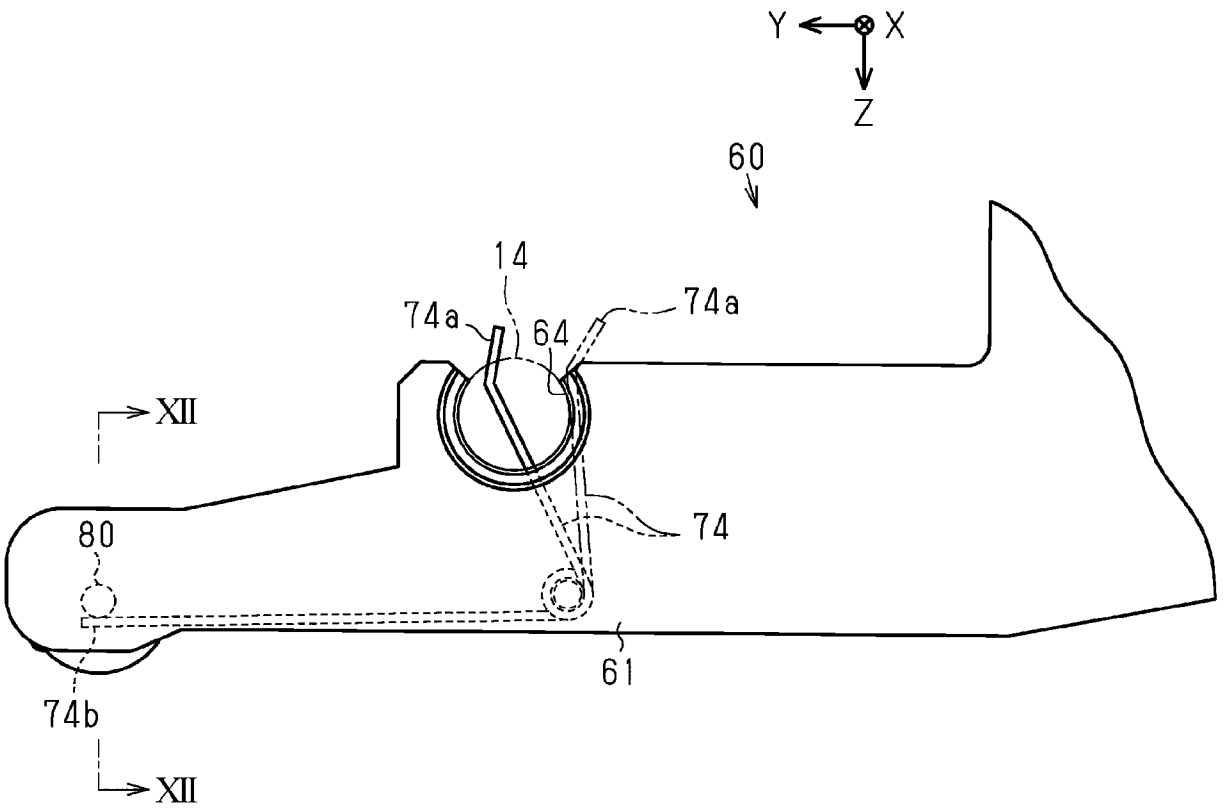
FIG. 11 is a side surface view illustrating the shaft support member that is provided with an electrical connection member.
Figure 12:
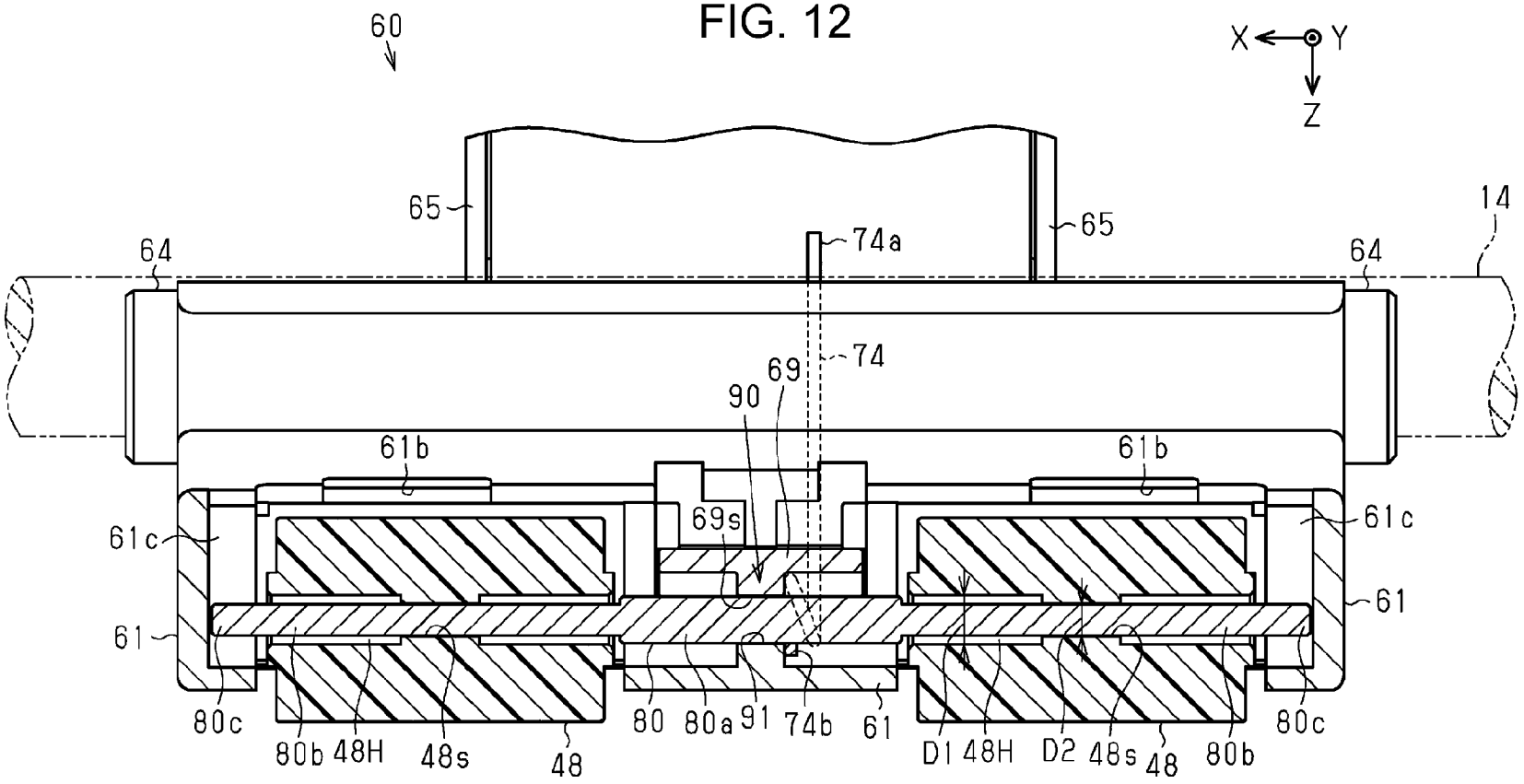
FIG. 12 is a front surface view of the shaft support member illustrating a cut surface on which a roller shaft and a driven roller that are supported by the shaft support member are cut away on a line XII-XII in FIG. 11.

As shown in FIGS. 11 and 12, the rotary shaft 80 which supports the driven roller 48 is attached to a position that is separated from the downstream side in the transport direction Y with respect to the rotary shaft 14 in the rotating member 61. Then, since the roller shaft 80 and the rotary shaft 14 which are positioned separated from each other in the transport direction Y are electrically connected, the torsion spring 74 which has conductivity is combined with the rotating member 61.

That is, in the torsion spring 74 that is combined with the rotating member 61, one end side 74*a* is displaced from a position which is indicated by a solid line to a position which is indicated by a two-dot chain line in FIG. 11, that is, in a direction in which torsion returns due to the rotary shaft 14 being inserted into the shaft attachment portion 64 of the rotating member 61. As a result, one end side 74*a* of the torsion spring 74 is in a state of abutting so as to press the rotary shaft 14 and another end side 74*b* is in a state of abutting so as to press the roller shaft 80. In this manner, the torsion spring 74 is provided as an electrical connection member which electrically connects the rotary shaft 14 and roller shaft 80 by respectively pressing the rotary shaft 14 and roller shaft 80.

Next, the roller shaft 80 and the two driven rollers 48 will be described.

As shown in FIG. 12, the two driven rollers 48 (first driven roller 48 and second driven roller 48) have a hole into which the roller shaft 80 is inserted, and in the shaft line direction of the roller shaft 80, have a through hole 48H in which an inner diameter D2 of the roller center portion is smaller than an inner diameter D1 of the roller end portion.

In at least one of the first and second driven rollers 48, the roller center portion in the through hole 48H is a cylindrical surface 48*s* that is able to contact the side surface of the roller shaft 80 and has a gap with a side surface of the roller shaft 80. That is, in the embodiment, the roller center portion in any one of the first and second driven rollers 48 is a cylindrical surface 48*s* which has a predetermined width.

The two driven rollers 48 are attached having a gap in the shaft line direction of the roller shaft 80 by respectively inserting a shaft end side part 80*b* which is positioned on both sides of the shaft center part 80*a* on the roller shaft 80 with respect to the respective through holes 48H. In addition, in the roller shaft 80, the shaft center part 80*a* is supported by the concave portion 91 of the rotating member 61 and the lid member 69 which configure the shaft support portion 90 of the shaft support member 60 between two driven rollers 48 in the shaft line direction.

In detail, the shaft center part 80*a* which is a shaft part that is supported by the shaft support portion 90 of the shaft support member 60 in one roller shaft 80 is thicker than the shaft end side part 80*b* that is a shaft part that rotatably supports the first and second driven rollers 48. The thick shaft center part 80*a* of the roller shaft 80 suppresses movement upward due to the lid member 69 that is moved to the closed position.

That is, in the lower portion of the lid member 69, the convex portion 69*s* protrudes which faces the concave portion 91 of the rotating member 61 and the roller shaft 80 suppresses movement in the up and down direction using the protruded convex portion 69*s* and the concave portion 91. Accordingly, in the embodiment, the shaft support portion 90 is configured by the concave portion 91 and the convex portion 69*s* of the lid member 69. Then, in the embodiment, the roller shaft 80 that is supported on the shaft support portion 90 has a gap between the concave portion 91 and the convex portion 69*s* at least in the up and down direction, and due to the gap, one roller shaft 80 is slidably supported in the up and down direction with the shaft support portion 90 as a support point.

In addition, in the embodiment, the concave portion 91 of the rotating member 61 has a bearing surface that is able to contact the side surface of the roller shaft 80 and has a gap with a side surface of the roller shaft 80. Accordingly, here, description using the drawings is omitted, but the side surface of the roller shaft 80 is in line contact or surface contact with the bearing surface in a case where one roller shaft 80 does not swing with the bearing surface as a support point by a gap with the bearing surface which configures the shaft support portion 90.

Next, the actions of the embodiment will be described.

To begin with, with reference to FIGS. 13 and 14, actions of the driven roller 48 that is attached to the shaft support member 60 will be described. Note that, in FIGS. 13 and 14, the driven roller 48, the roller shaft 80, the shaft support portion 90 of the roller shaft 80, the driving roller 46, and the medium M are schematically illustrated for ease of understanding of explanation.

Figure 13:
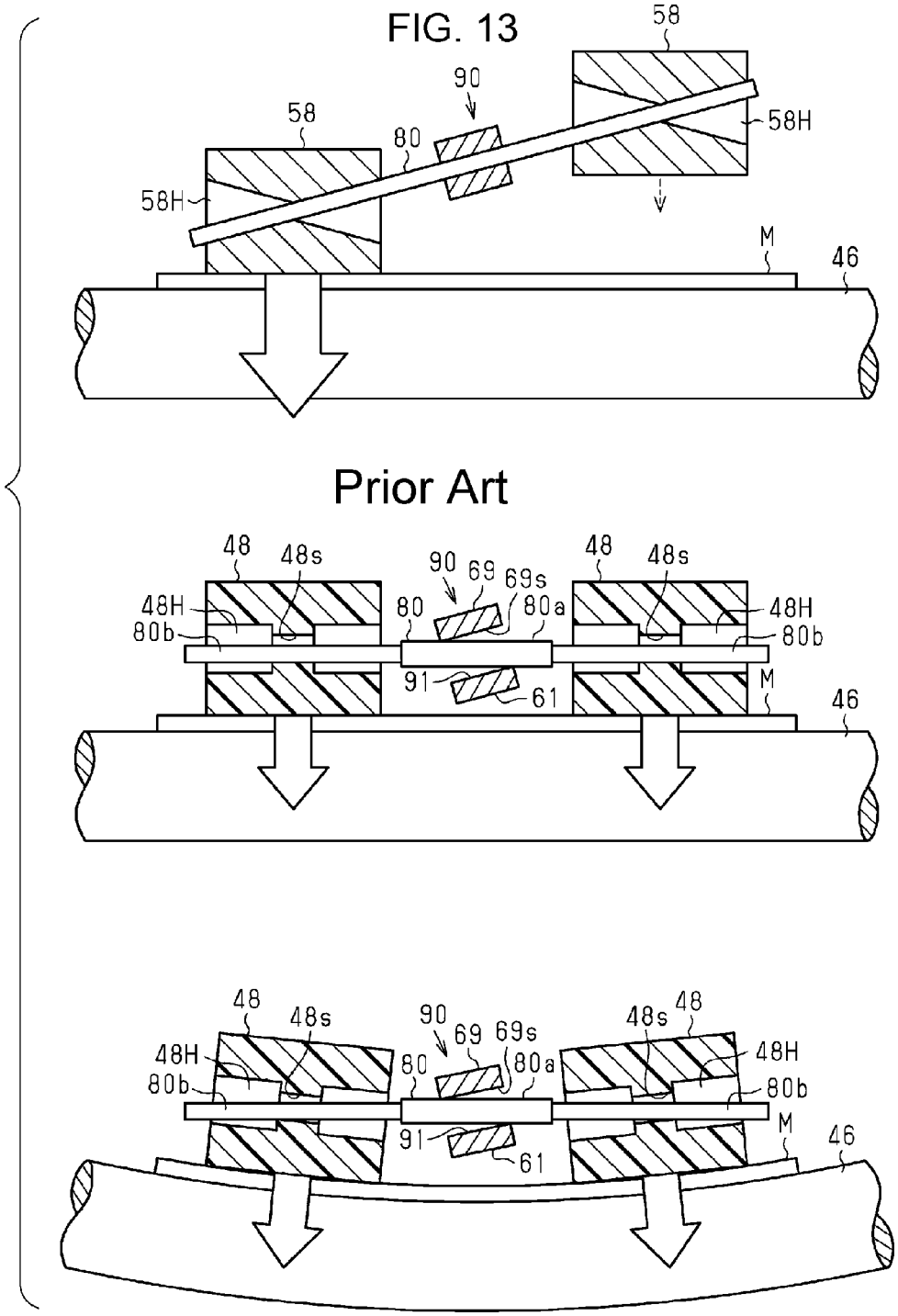
FIG. 13 is a schematic view which describes pressing force of the driven roller when the medium is pressed.

As shown in the drawing on the upper side in FIG. 13, a driven roller 58 in the related art is able to hold the revolving shaft of the driven roller and the revolving shaft of the driving roller in parallel using the through hole 58H that is set in a taper shape in a case where the driven roller 58 which has the structure of the related art presses the medium M on the driving roller 46. However, when the roller shaft 80 is supported without a gap in the shaft support portion 90, a shaft line of the roller shaft 80 is maintained in an inclined state with respect to the revolving shaft of the driving roller 46. For this reason, there is a state in which only one driven roller 48 presses the medium M, and as indicated by the white arrow in the drawing on the upper side of FIG. 13, the pressing force which is larger than pressing force applied to the medium of the driven roller 58 may be generated when all of the plurality of driven rollers 58 interpose the medium M.

In contrast to this, as shown in the drawing in the center of FIG. 13, in a case where the driven roller 48 which has the configuration of the embodiment presses the medium M on the driving roller 46, the revolving shaft of the driven roller 48 and the revolving shaft of the driving roller 46 are held in parallel by a gap between the cylindrical surface 48*s* of the predetermined width that is provided in the through hole 48H and the side surface of the roller shaft 80 (shaft end side part 80*b*). In addition, since the side surface of the roller shaft 80 is supported having a gap between the concave portion 91 of the rotating member 61 and the convex portion 69*s* of the lid member 69, the roller shaft 80 is in a state of swinging with the shaft support portion 90 as a support point along the pressing direction in which the driven roller 48 presses the medium M on the driving roller 46 and the shaft line is parallel to the revolving shaft of the driving roller 46. For this reason, there is a state in which a plurality of driven rollers 48 press the medium M, and as indicated by the white arrow in the center drawing of FIG. 13, the pressing force is a uniform size which is substantially the same in each driven roller 48.

In addition, in a case where the revolving shaft of the driven roller 48 and the shaft line of the roller shaft 80 are parallel, the cylindrical surface 48*s* of the driven roller 48 is in line contact or surface contact with the side surface of the roller shaft 80 and the driven roller 48 is stably supported and rotates on the roller shaft 80.

Furthermore, as shown in the lower side drawing of FIG. 13, in a case where warping is generated on the driving roller 46, the driven roller 48 which has the configuration of the embodiment is inclined such that the revolving shaft of the driven roller 48 is parallel to the revolving shaft of the driving roller 46 by a gap between the cylindrical surface 48*s* of the predetermined width that is provided in the through hole 48H and the side surface of the roller shaft 80 (shaft end side part 80*b*). For this reason, there is a state in which a plurality of driven rollers 48 equally press the medium M, and as indicated by the white arrow in the lower side drawing of FIG. 13, the pressing force is a uniform size which is substantially the same in each driven roller 48.

In addition, in the embodiment, bending force is applied to the shaft center part 80*a* of the roller shaft 80 that is supported on the shaft support portion 90 which is a swing support point by reaction force of the pressing force that is generated when the two driven rollers 48 press the medium M in the one roller shaft 80. At this time, since the shaft center part 80*a* of the roller shaft 80 is thickened, changing of shape accompanying bending force due to reaction force is suppressed. Alternatively, although description using drawings is omitted here, even if the roller shaft 80 is reflected accompanying bending force, the driven roller 48 is maintained in a state in which the revolving shaft of the driven roller 48 is parallel to the revolving shaft of the driving roller 46 by a gap between the cylindrical surface 48*s* of the predetermined width that is provided in the through hole 48H and the side surface of the roller shaft 80 (shaft end side part 80*b*).

Figure 14:
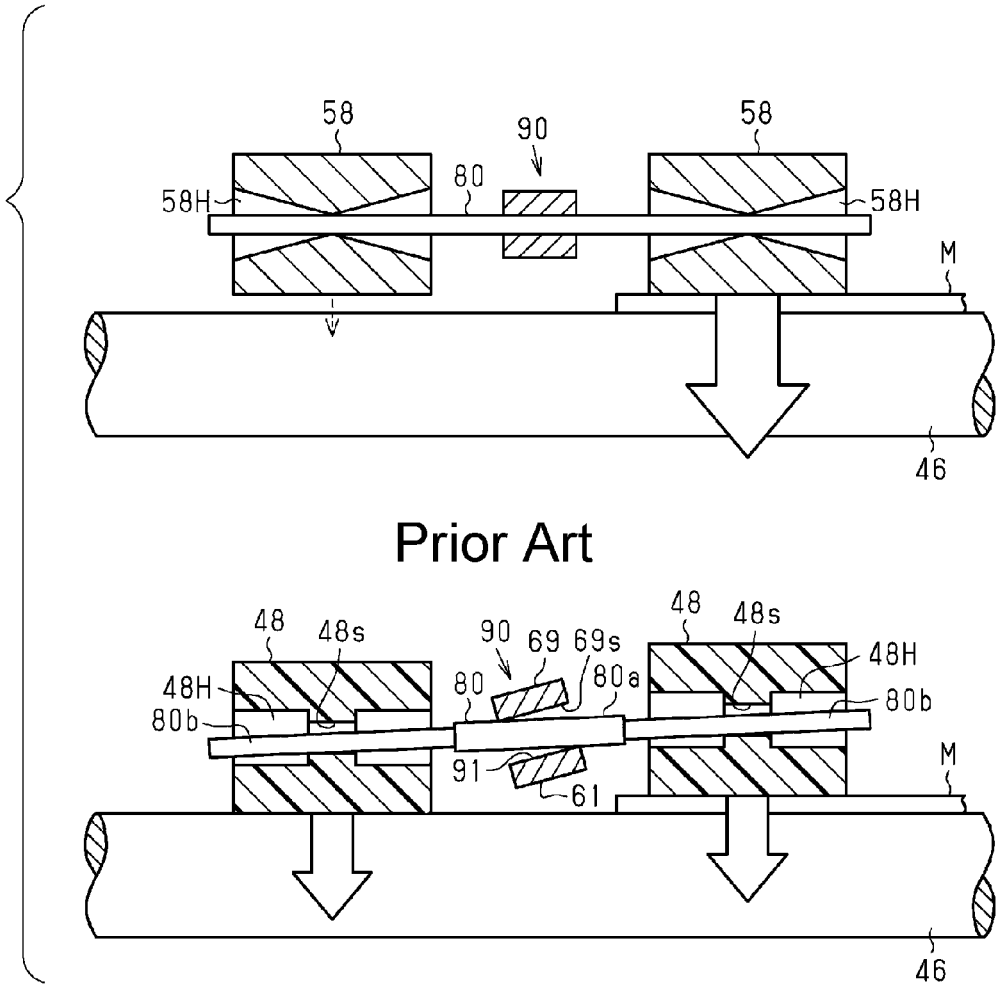
FIG. 14 is a schematic view which describes pressing force of the driven roller when an end portion of the medium is pressed.

Next, as shown in the upper side drawing in FIG. 14, at the end portion of the medium M, a driven roller 58 in the related art is able to maintain the revolving shaft of the driven roller and the revolving shaft of the driven roller in parallel using the through hole 58H that is set in a taper shape in a case where only one out of two driven rollers 58 which has the structure of the related art presses the medium M on the driving roller 46. However, when the roller shaft 80 is supported without a gap in the shaft support portion 90, a shaft line of the roller shaft 80 is maintained in a state of being, for example, parallel without being inclined with respect to the revolving shaft of the driving roller 46. For this reason, there is a state in which only one driven roller 58 (driven roller 58 on the right side in FIG. 14) presses the medium M, and as indicated by the white arrow in the drawing on the upper side of FIG. 14, the pressing force which is larger than pressing force applied to the medium M of the driven roller 58 may be generated when all of the plurality of driven rollers 58 interpose the medium M.

In contrast to this, as shown in the lower side drawing of FIG. 14, in a case where the first driven roller 48 on the right side of the illustration which has the configuration of the embodiment presses the medium M on the driving roller 46, the side surface of the roller shaft 80 (shaft end side part 80*a*) is supported to have a gap in the shaft support portion 90. For this reason, there is a state in which a shaft line of the roller shaft 80 is inclined with respect to the revolving shaft of the driving roller 46 such that the second driven roller 48 on the left side in the drawing swings with the shaft support portion 90 as a support point along the pressing direction in which the medium M is pressed on the driving roller 46 and contacting the driving roller 46. In this state, the respective revolving shafts of the first and second driven rollers 48 and the revolving shaft of the driving roller 46 are held in parallel by a gap between the cylindrical surface 48*s* of the predetermined width that is provided in the through hole 48H and the side surface of the roller shaft 80 (shaft end side part 80*b*). As a result, there is a state in which the first driven roller 48 presses the medium M and the second driven roller 48 presses the driving roller 46, and as indicated by the white arrow in the lower side drawing of FIG. 14, each pressing force is a uniform size which is substantially the same in each driven roller 48. That is, pressing force in which only the first driven roller presses the medium M is the same size as pressing force in a case where both of the first and second driven rollers 48 press the medium M.

In addition, as an action of the shaft support member 60 of the embodiment, it is possible to remove the driven roller 48 from the shaft support member 60 using a structure in which the driven roller 48 is removed.

In addition, as an action of the shaft support member 60 of the embodiment, the driven roller 48 is formed by a member which has conductivity (for example, conductive polytetrafluoroethylene) and suppresses charging of charge on the driven roller 48 due to conductivity of the material.

In addition, as an action of the shaft support member 60 of the embodiment, the cover 68 that is provided to be attachable and detachable to the rotating member 61 is formed by a resin material without conductivity (for example, aramid fiber), and for example, is in a state in which charged ink mist does not come close to the cover 68 due to a charged state (for example, positive charge and negative charge) according to a charging rate of the resin material. Thereby, adherence of ink mist to the medium M is suppressed.

Alternatively, as an action of the shaft support member 60 of the embodiment, static electricity that is charged on the driven roller 48 side is dissipated to the rotary shaft 14 side by the torsion spring 74 which is provided as an electrical connection member which electrically connects between the rotary shaft 14 and the roller shaft 80.

According to the embodiment, it is possible to obtain the effects as above.

(1) There is a possibility that the driven roller 48 is replaced by removing the roller shaft 80 from the shaft support member 60, and it is possible to provide the driven roller 48 which transports the medium M at a uniform pressing force due to a direct roller shaft 80 supporting the shaft support member 60 which is one member. In addition, it is possible to clean the driven roller 48 by removing the roller shaft 80 from the shaft support member 60.

(2) It is possible to easily remove the driven roller 48 from the shaft support member 60 and attach to the shaft support member 60 by inserting the roller shaft 80 into the concave portion 91 and extracting from the concave portion 91 via the opening 92.

(3) It is possible to easily replace the driven roller 48 by removing the roller shaft 80 which is inserted into the concave portion 91 from the shaft support member 60 and attaching to the shaft support member 60 by opening and closing the opening 92 by slidably moving the lid member 69.

(4) Since it is possible to suppress charging of charge to the driven roller 48, for example, it is possible to suppress soiling of the medium M due to ink mist being adhered to the medium M.

(5) Since it is possible to move charge which is charged to the driven roller 48 to the rotary shaft 14 that is an example of the revolving shaft that is provided in the shaft support member 60 via the torsion spring 74 that is an example of the electrical connection member from the roller shaft 80, it is possible to suppress charge of the driven roller 48 with high probability.

(6) It is possible to suppress adherence of ink (mist) to the roller outer peripheral surface 48*a* of the driven roller 48 using the cover 68 that is attached to the rotating member 61 and it is possible to replace the driven roller 48 by removing the cover 68 from the rotating member 61.

(7) In one roller shaft 80, for example, in a case where only the first driven roller 48 presses the medium M, pressing force of the first driven roller 48 on the medium M is suppressed to pressing force at which both the first driven roller 48 and the second driven roller 48 press the medium M due to swinging by the roller shaft 80. As a result, it is possible to transport the medium M at a uniform pressing force using the first driven roller 48 and the second driven roller 48.

(8) One roller shaft 80 is swingable with a bearing surface as a support point by a gap with the bearing surface which configures the shaft support portion 90, and in a case where the one roller shaft 80 does not swing, the side surface of the roller shaft 80 is stably supported on the shaft support member 60 by being in line contact or surface contact with the bearing surface.

(9) The first driven roller 48 and the second driven roller 48 are swingable with the cylindrical surface 48*s* of the roller center portion of the through hole 48H as a support point, and in a case where the driven rollers 48 do not swing, the cylindrical surface 48*s* is stably supported on the roller shaft 80 by being in line contact or surface contact with the side surface of the roller shaft 80.

(10) In a case where bending force is applied to a support point of swinging, in a thick roller shaft 80 at the support point of swinging, change of shape due to bending force is suppressed by reaction force of the pressing force that is caused when the first driven roller 48 and the second driven roller 48 press the medium M with respect to one roller shaft 80.

(11) Since one roller shaft 80 is caused to swing along the pressing direction in which the first driven roller 48 and the second driven roller 48 press the medium M on the driving roller 46, it is possible to appropriately suppress pressing force at which the first driven roller 48 and the second driven roller 48 press the medium M due to swinging by the roller shaft 80.

Note that, the embodiment may be modified as in the modification example shown below. In addition, it is possible to arbitrarily combine the embodiment and each modified example.

In the embodiment, the shaft support portion 90 of the shaft support member 60 may have a configuration other than the concave portion 91 and the convex portion 69*s*. For example, the shaft support portion 90 may be the concave portion 91 which has, for example, an opening in the horizontal direction or the down direction other than the up direction out of directions which intersect with the shaft line direction of the roller shaft 80. Alternatively, the shaft support portion 90 may be provided with a component other than the concave portion 91 which has the opening 92 into which the roller shaft 80 is insertable from the direction which intersects with the shaft line direction of the roller shaft 80. For example, although illustration is omitted here, the shaft support portion 90 which is provided in the rotating member 61 may be the through hole through which the roller shaft is passed in the insertable scanning direction X from the shaft line direction of the roller shaft 80.

In the embodiment, the slidably movable lid member 69 may not be provided in the shaft support member 60 between the closed position which covers the opening 92 of the concave portion 91 and the open position which does not cover the opening 92 of the concave portion 91. For example, in a case where the opening 92 has the concave portion 91 facing downward so as to face the medium M, since the roller shaft 80 is maintained within the concave portion 91 at the reaction force of the pressing force on the medium M of the driven roller 48, in the shaft support portion 90 in the embodiment, the lid member 69 is not necessary.

In addition, in a case where an opening dimension of the opening 92 of the concave portion 91 is able to be changed (increased) due to elastic deformation, the dimension of the opening 92 may be a smaller dimension than a shaft diameter of the roller shaft 80. Consequently, since the roller shaft 80 widens the opening 92 and presses the concave portion 91 and is maintained within the concave portion 91 by returning the opening 92 to the original dimension, in this case, the lid member 69 is not necessary. In a case where such a lid member 69 is not provided, the shaft support portion 90 is configured by the concave portion 91.

In the embodiment, the driven roller 48 may not be formed by a member which has conductivity. For example, the driven roller 48 may be formed by a resin material (for example, urethane) and the like which does not have conductivity.

In the embodiment, the shaft support member 60 may not be provided with the rotary shaft 14 which is a center of rotation when the shaft support member 60 is rotated in a direction in which the medium M is pressed on the driving roller 46 by the driven roller 48. For example, there may be a configuration in which the shaft support member 60 slidably moves in the up and down direction. In this case, the torsion spring 74 as the electrical connection member may be electrically connected between the roller shaft 80 and the shaft support member 60. Alternatively, there may be a configuration in which the torsion spring 74 is not combined with the shaft support member 60.

In the embodiment, in a case where the shaft support member 60 is configured to move under own weight, since the shaft support member 60 (rotating member 61) moves without being biased by the spring 73 that is an example of a biasing member, the spring 73 is unnecessary.

In the embodiment, the shaft support member 60 may not be provided with the cover 68 which covers at least a part of a roller outer peripheral surface 48*a* of the driven roller 48 to be attachable and detachable with respect to the shaft support member 60. For example, in a case where there is a configuration in which the roller shaft 80 is inserted from the shaft line direction of the roller shaft 80 with respect to the shaft support portion 90 which is provided on the rotating member 61, since it is possible to take out the roller shaft 80 disconnected from the shaft support portion 90 without removing the cover 68, there is a possibility that the cover 68 is not able to detach with respect to the shaft support member 60. Alternatively, in a case where, for example, a probability that the roller outer peripheral surface 48*a* is soiled by ink mist and the like is low, the cover 68 may not be provided in the shaft support member 60.

In the embodiment, the shaft support portion 90 of the shaft support member 60 may not be a bearing surface that is able to contact the side surface of the roller shaft 80 and has a gap with the side surface of the roller shaft 80. For example, the shaft support portion 90 of the shaft support member 60 may be formed using a rib which has a plurality of apex angles and is not a surface.

In the embodiment, in at least one of the first driven roller 48 and the second driven roller 48, the roller center portion may not be the cylindrical surface 48*s* that is able to contact the side surface of the roller shaft 80 and has a gap with a side surface of the roller shaft 80. For example, the roller center portion may be set with the rib which has an apex angle and is not a surface.

In the embodiment, in the one roller shaft 80, a shaft part which is supported by the shaft support portion 90 of the shaft support member 60 may not be thicker than a shaft part which rotatably supports the first driven roller 48 and the second driven roller 48. For example, the roller shaft 80 may have the same thickness over the entirety.

In the embodiment, the shaft support member 60 may not have a pair of longitudinal grooves 61*c* (guide grooves) which movably guide both shaft end portions of one roller shaft 80 along the pressing direction in which the medium M is pressed on the driving roller 46 by the first driven roller 48 and the second driven roller 48. For example, although description using drawings is omitted here, in a case where there is a configuration in which the gap between the concave portion 91 and the roller shaft 80 is provided in the up and down direction which is the pressing direction in which the medium M is pressed on the driving roller 46 by the driven roller 48 and is not provided in the transport direction Y, the roller shaft 80 suppresses movement along the transport direction Y. Accordingly, in this case, since inclination is suppressed with respect to the revolving shaft of the driving roller 46 accompanying movement of the roller shaft 80 in the transport direction Y, there may be a configuration in which there is one longitudinal groove 61*c* (guide groove) such that either shaft end portion 80*c* of both shaft end portions of one roller shaft 80 is movably guided. Alternatively, there may be a configuration in which the shaft support member 60 does not have the longitudinal groove 61*c*.

In the embodiment, the cover 68 which covers the roller outer peripheral surface 48*a* of the driven roller 48 may be formed of a material which has conductivity (conductive resin material or metal material). In this case, adherence of the charged ink mist to the cover 68 and adherence by reaching the driven roller 48 or the medium M are suppressed.

In the embodiment, the plurality of three or more driven rollers 48 may be rotatably supported on one roller shaft 80. In this case, two driven rollers 48 are equivalent to the first driven roller 48 and the second driven roller 48 of the embodiment.

In the embodiment, the printing apparatus 11 may not be provided with the holding portion 22 on which the feeding portion 20 winds the medium M, and a single sheet medium M that is not formed in a roll body may be fed to the printing portion 50.

In the embodiment, the printing portion 50 may not be provided with the carriage 52, may be provided with a printing head which is fixed in an elongated shape that corresponds to the entire width of the medium M, and may be modified to a printing apparatus of a so-called full-line type. In the printing head in this case, the print range may be across the entire width of the medium M by arranging in parallel a plurality of unit heads on which nozzles are formed and the print range may be across the entire width of the medium M by arranging multiple nozzles so as to be across the entire width of the medium M in a single elongated head.

In the embodiment, a recording material which is used in printing may be a fluid body other than ink (including a liquid, a liquid form body in which a particulate functional material is dispersed or mixed in a liquid, a fluid form body such as gel, and a solid body which is able to be discharged by flowing as a fluid body). For example, there may be a configuration in which recording is performed by discharging a liquid form body including, in a dispersed or dissolved form, material such as an electrode material or color material (pixel material) which are used in manufacture and the like of a liquid crystal display, an electro-luminescence (EL) display, and a surface light emission display.

In the embodiment, the printing apparatus 11 may be a fluid form body discharge apparatus which discharges a fluid form body such as gel (for example, physical gel), or a powder and granular body discharge apparatus (for example, a toner jet type recording apparatus) which discharges a solid body as an example of a powder (powder and granular body) such as toner. Note that, in the specification, "fluid body" is a concept which does not include a fluid body which comprises only gas, and for example, liquid (including an inorganic solvent, an organic solvent, a solution, a liquid resin, a liquid metal (molten metal), and the like), a liquid form body, a fluid form body, a powder and granular body (including a granular body and a powder body), and the like are included in fluid body.

In the embodiment, the printing apparatus 11 is not limited to a printer which performs recording by discharging fluid such as ink, for example, the printing apparatus 11 may be a non-impact printer such as a laser printer, an LED printer, and a thermal transfer printer (including a sublimation printer), and may be an impact printer such as a dot impact printer.

In the embodiment, the medium M is not limited to a paper sheet, and may be a plastic film, thin plate material, and the like, and may be a fabric which is used in a printing apparatus and the like.

This application claims priority under 35 U.S.C. §119 to Japanese Patent Application No. 2015-194704, filed Sep. 30 2015. The entire disclosure of Japanese Patent Application No. 2015-194704 is hereby incorporated herein by reference.

What is claimed is:

1. A printing apparatus comprising:

a printing portion for printing on a medium;

a driving roller for transporting the medium to the printing portion;

a first driven roller and a second driven roller which are respectively supported with a gap in one roller shaft in a shaft line direction of the roller shaft and rotate around the roller shaft while pressing the transported medium on the driving roller; and a shaft support member that has a shaft support portion which supports the roller shaft between the first driven roller and the second driven roller, wherein the first driven roller and the second driven roller have a through hole into which the roller shaft is inserted and in which an inner diameter in a roller center portion is smaller than an inner diameter of a roller end portion in the shaft line direction, and wherein the roller shaft is supported so as to be laterally swingable with the shaft support portion as a support point.

2. The printing apparatus according to claim 1, wherein the shaft support portion of the shaft support member is a bearing surface which is able to contact a side surface of the roller shaft and has a gap with the side surface of the roller shaft.

3. The printing apparatus according to claim 1, wherein in at least one of the first driven roller and the second driven roller, the roller center portion in the through hole is a cylindrical surface which is able to contact the side surface of the roller shaft and has a gap with the side surface of the roller shaft.

4. The printing apparatus according to claim 1, wherein in one roller shaft, a shaft part which is supported by the shaft support portion of the shaft support member is thicker than a shaft part which rotatably supports the first driven roller and the second driven roller.

5. The printing apparatus according to claim 1, wherein the shaft support member includes a guide groove that movably guides at least one shaft end portion out of both shaft end portions of the one roller shaft along a pressing direction in which the first driven roller and the second driven roller press the medium on the driving roller.

* * * * *